US005100107A

United States Patent [19]

Latta

[11] Patent Number: 5,100,107

[45] Date of Patent: Mar. 31, 1992

[54] COMPOSITE BOARDS

[76] Inventor: Russell A. Latta, 4910 Canto Dr., San Jose, Calif. 95124

[21] Appl. No.: 685,916

[22] Filed: Apr. 15, 1991

[51] Int. Cl.[5] ..... E04H 17/14

[52] U.S. Cl. ..... 256/19; 256/24; 256/73

[58] Field of Search ..... 256/19, 24, 73, 25

[56] References Cited

U.S. PATENT DOCUMENTS

| | | | |
|---|---|---|---|
| 3,342,033 | 9/1967 | Crouch et al. | 256/19 X |
| 3,454,262 | 7/1969 | Romauo | 256/24 X |
| 3,512.759 | 5/1970 | Resler | 256/19 |
| 3,652.060 | 3/1972 | Glover | 256/19 |
| 3,698,692 | 10/1972 | Burrows, Jr. | 256/19 |

OTHER PUBLICATIONS

Mark Feirer, Laminated-Veneer Lumber, Fine Homebuilding, Dec. 1988/ Jan. 1989, vol. 50, pp. 40–46.

*Primary Examiner*—Andrew V. Kundrat

*Attorney, Agent, or Firm*—Rosenblum, Parish & Bacigalupi

[57] ABSTRACT

Recycled lumber is used to create modular units of fencing that is superior both economically and in strength to new lumber. Composite redwood boards are comprised of three $\frac{5}{8}'' \times 7''$ panel sections and two elongated $1'' \times 1''$ rails having a dado running the length of the rail. The panels are lap jointed together, and the dadoed rails brace the panels and provide stability. The rails are stapled to the panels and create a nominal $1'' \times 8''$ composite board.

6 Claims, 5 Drawing Sheets

COMPOSITE BOARDS

BACKGROUND OF THE INVENTION

1. Field of the Invention

This invention relates generally to fencing material, and more particularly to composite boards made from recycled lumber used as modular units for fencing.

2. Brief Description of the Prior Art

Cement masonry fence walls, made from prefabricated interlocking modules, existed at least as early as 1970. U.S. Pat. No. 3,512,759 discloses one such design. Cement module walls can be erected with minimal labor and equipment, and can be readily dismantled and reconstructed. The cement modules must be fabricated specifically for the purpose of creating such an interlocking wall, and thus can not be made from previously used or recycled materials. Additionally, cement is generally considered to be less aesthetically pleasing than natural materials such as wood.

The basket weave fence disclosed in U.S. Pat. No. 3,652,060 is constructed from pieces of wood veneer that have been rejected from use as plywood panels due to defects or irregular shapes. Although the rejected pieces of wood veneer are waste or scrap material, the material is new lumber—it has not been used in construction. Although veneer boards have improved weather and aging characteristics due to the peeling of the log done during veneer production, they do not have the same beneficial characteristics of wood that has actually undergone aging in natural weather conditions Other types of modular fence construction are comprised of C-channel boards. U.S. Pat. No. 3,698,692 shows how a multiple of C-channel boards can be used for both fence rails and fence posts. The rails interlock with the posts to form the fence. In this design, as in the patents previously discussed, the rails and posts must be made specifically for this application and thus are made from new lumber or other materials. Additionally, this design requires that the rails and posts be one continuous length of material, thereby eliminating the possibility of using shorter pieces of material normally associated with scrap lumber or recycled lumber.

SUMMARY OF THE INVENTION

It is therefore a primary objective of the present invention to provide a composite board made from used lumber.

It is another objective of the present invention to provide modular units for fencing.

It is a further objective of the present invention to provide economical redwood lumber composite boards for use in construction.

It is yet another objective of the present invention to provide fencing material that will sustain only minimal shrinkage or warpage due to prior aging and weatherizing.

It is a further objective of the present invention to provide a fence, consisting of modular boards positioned vertically, having a cross member at the top of the fence and another at the bottom of the fence, such that no additional cross members are required at the mid-line or anywhere else on the fence, thereby making the fence climb resistant.

Briefly, a preferred embodiment of the present invention includes a piece of composite redwood board comprising three $\frac{5}{8}''\times 7''$ panel sections and two elongated $1''\times 1''$ rails having a dado running the length of the rail. The panels are placed end-to-end and fitted together at their ends utilizing a lap joint. Each of the common sides of the fitted panels are mated with the dadoed side of a rail, and the rails are then joined to the panels thereby creating a nominal $1''\times 8''$ fence board.

It is an important advantage of the present invention that the boards are made from used wood, thereby enhancing the environment through recycling.

It is another advantage of the present invention that each board is a modular unit of fencing and can be easily replaced on a unit by unit basis.

It is a further advantage of the present invention that the boards are economically efficient since used lumber is low cost and the labor required to make each composite board is minimal.

It is yet another advantage of the present invention that the composite boards will only sustain minimal shrinkage or warpage, as they are already naturally aged.

It is yet a further advantage of the present invention that it provides fencing material that is aesthetically pleasing yet climb resistant.

These and other objects and advantages of the present invention will no doubt become apparent to those skilled in the art after having read the following detailed description of the preferred embodiment which is contained in and illustrated by the various drawing figures.

IN THE DRAWING

DETAILED DESCRIPTION OF THE PREFERRED EMBODIMENT

Figure 1:
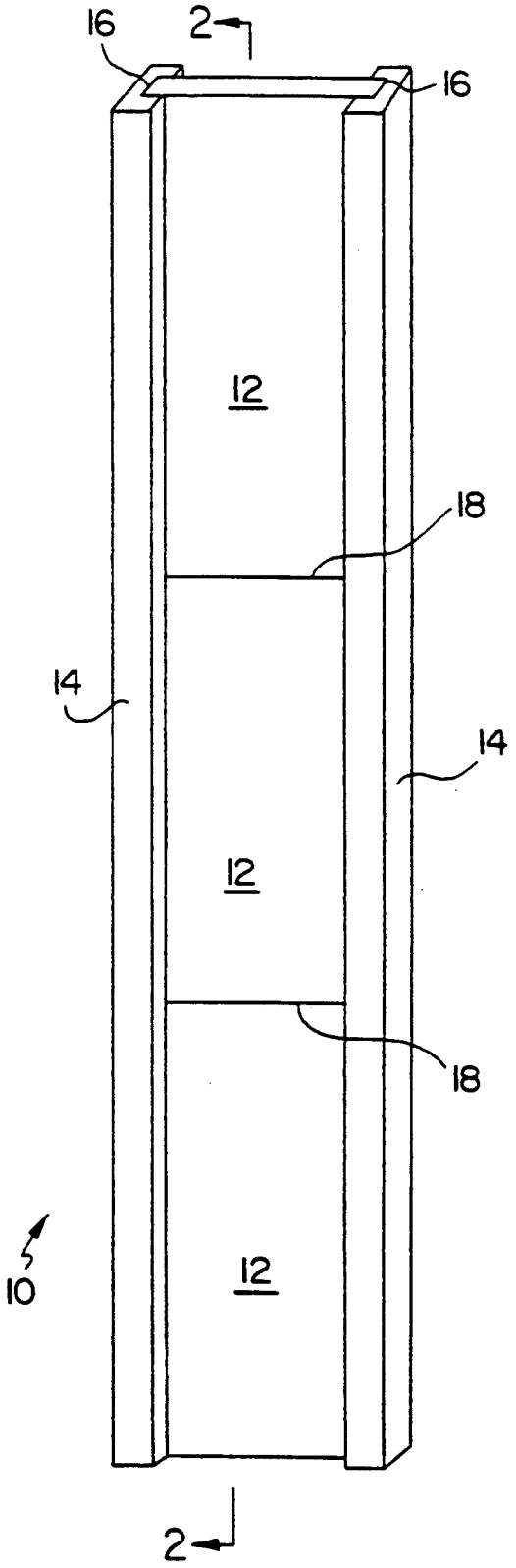
FIG. 1 is a perspective view of a composite board in accordance with the present invention.

FIG. 1 illustrates a preferred embodiment of the composite board 10 of the present invention The overall board size is a nominal one inch thick by 8 inches wide by five feet long ($1''\times 8''\times 5'$) and is comprised of three panels 12 sandwiched by two rails 14. The panels 12 are usually $\frac{5}{8}$ inch thick by 7 inches width ($\frac{5}{8}''\times 7''$), as that is the most common size of board found as used fencing. The panels 12 are generally 20 inches long (for a 5' composite board) and are disposed end-to-end to create a stacked panel configuration that comprises the main body of the board. The rigid lumber rails 14 used in conjunction with $\frac{5}{8}''\times 7''$ panels are 1 inches thick by 1 inches width ($1''\times 1''$), with a dado 16 running the full length of one side.

The stacked panels 12 are ship lapped at their adjoining edges. The ship lap joints 18 will be further illustrated below. The rigid lumber rails 14 hold the stacked panels 12 together by mating the common sides of the stacked panels 12 with the dado 16 of the rails 14, thereby creating a clamped configuration that sandwiches the panels 12 together to prohibit lateral movement and also to brace the panels to prohibit separation of the panels at the lap joints 18. The joinder of the rails and panels will be further illustrated below.

Figure 2:
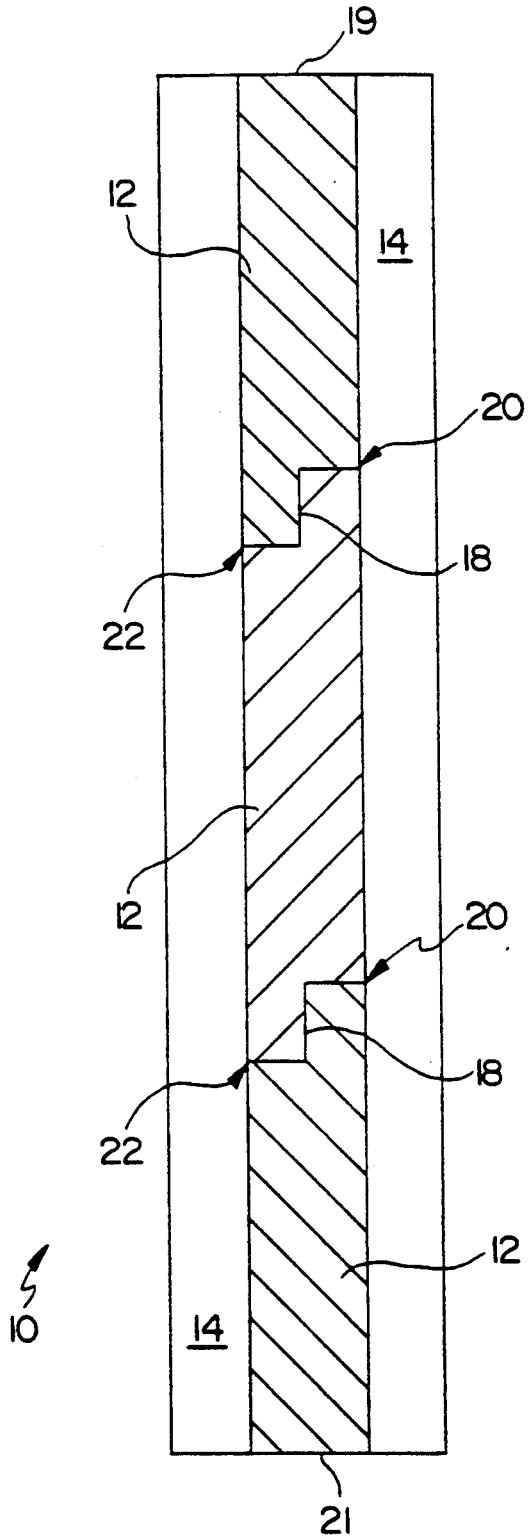
FIG. 2 is a cross section of the board in FIG. 1, taken along the line 2—2 shown in FIG.

FIG. 2 is a cross sectional view of the composite board 10 in FIG. 1, taken along the line 2—2, further illustrating the lap joints 18 between the panels 12. Only the board ends between adjoining panels are lapped, such that the outer ends 19 and 21 of the composite board 10 are flat cut. The lap joints 18 are used for aesthetics, weatherproofing and increased stability. Light showing through cracks or butt seams in a fence detracts from the fences beauty as well as its function—providing privacy, and the lap joint 18 causes the seam line 20 and 22 between panels to be at different places on each side of the board, so that light will not show through the board. Similarly, the lap joint 18 enhances weatherproofing because it inhibits dirt and water from seeping through the joint to the other side of the board. Additionally, lap joints give the composite board greater lateral stability than straight butt seams.

Figure 3:
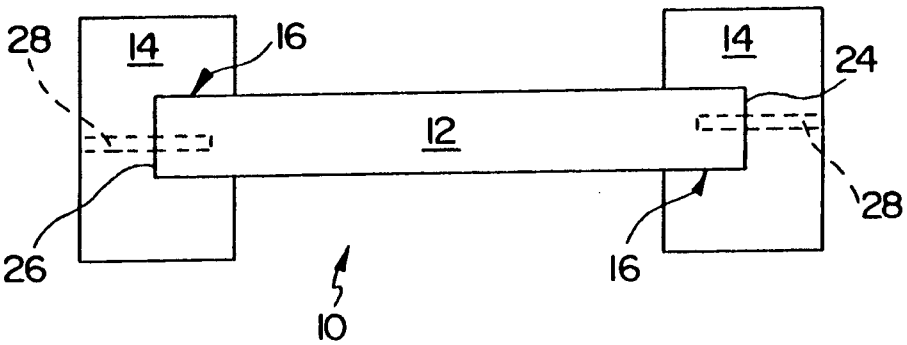
FIG. 3 is a top view of the board depicted in FIG. 1.

FIG. 3 is a top view of the board 10 depicted in FIG. 1, illustrating the joinder of the rails 14 to the panels 12. Each common side edge 24 and 26 of the stacked panels 12 is coupled within the dado 16 in the rail 14. The rails are then fastened to the panels with a plurality of staples 28 that pass through the side of the rails 14 and into the side edges 24 and 26 of the panels 12.

Figure 4:
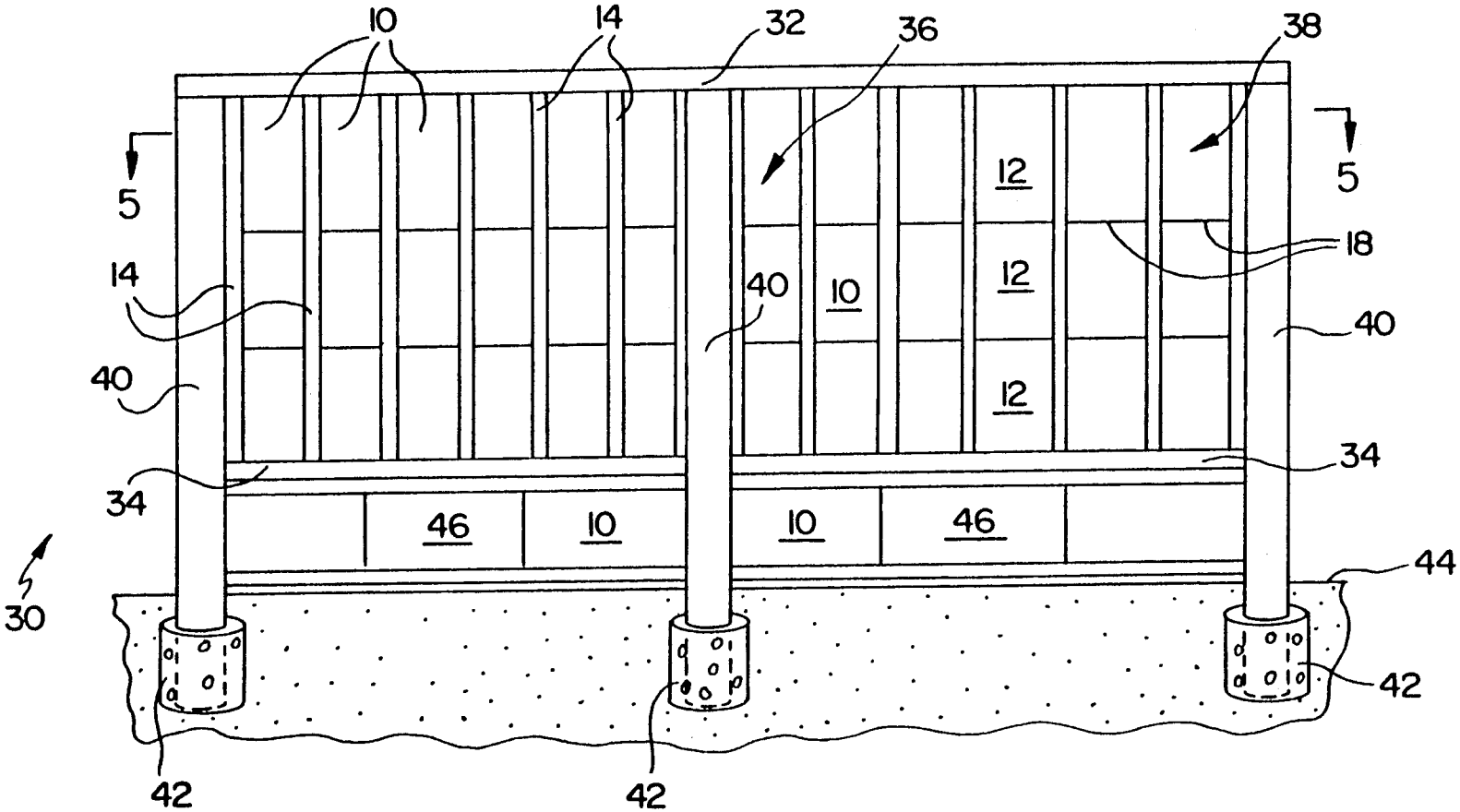
FIG. 4 is an elevational view of a fence comprising a plurality of the composite boards illustrated in FIG. 1.

A suggested fence design, using composite boards, is shown in FIG. 4. A plurality of composite boards 10 positioned vertically make up the greatest area of the fence 30. The vertical boards are fastened to 2"×4" header and footer beams, 32 and 34 respectively, for bracing utilizing nails, staples or similar attachment means. The beams 32 and 34 in turn, as well as the endmost composite boards 36 and 38, are attached to 4"×4" posts 40 that are grounded in cement 42 and buried below ground level 44. An optional kickboard 46 that is longer and wider than the composite boards 10, disposed horizontally at the base of the fence and attached to the posts 40 and the underside of the footer beam 34, can be included so that the bases of the vertical composite boards 10 will not be spoiled by ground moisture or dirt. Of course, horizontally disposed composite boards could alternatively be positioned proximate the top of the fence structure 30 (not shown) where additional privacy is desired.

The frame of the fence—the 4"×4" posts and 2"×4" beams—is strongest when new lumber is used. Aesthetically, the composite boards, although made of recycled lumber, do not compete in beauty with the new wood frame because the panels 12 and rails 14 of the composite board 10 are refinished prior to assembly and thus have the look of new wood without the risk of shrinking and warping concomitant with new lumber. Further, the use of lap joints 18 and rigid lumber rails 14 gives the composite boards 10 added strength axially as well as laterally. The composite boards 10 are less flexible than a similarly sized board of one piece construction. Additionally, if one section of fence becomes damaged, the composite boards can be changed out individually as each is a modular unit.

Figure 5:
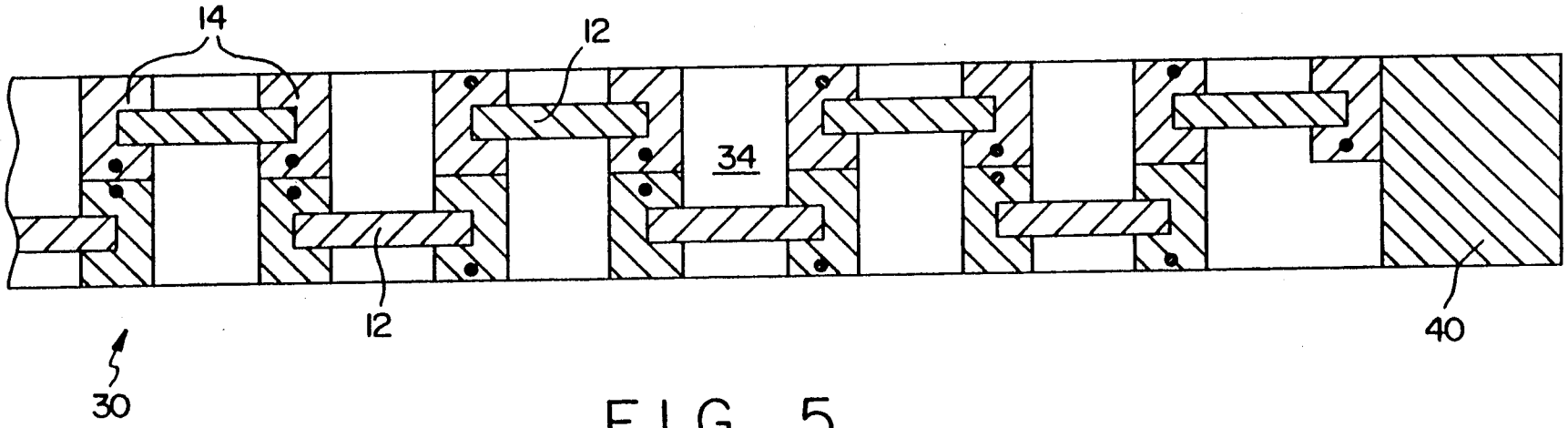
FIG. 5 is a cross sectional view of a portion of the fence shown in FIG. 4, taken along the line 5—5 of FIG. 4.

The composite boards 10 comprising the fence in FIG. 4 are aligned in series yet staggered such that the rails of each board overlap. This is better illustrated in FIG. 5, depicting a cross sectional view of a portion of the fence 30 shown in FIG. 4, taken along the line 5—5 in FIG. 4. In this configuration, the fence 30 is given increased strength in the lateral direction due to the overlapping of the rails 14 along the length of the fence. Also, this configuration provides greater stability in the vertical direction (over a fence where the composite boards are simply placed side-by-side) because the full width of the header and footer beams (only footer beam 34 is shown) is being utilized. Downwardly projecting nails 50 are used to attach the header beam to the rails 14. Similar nails 50 (not shown) project upwardly from the footer beam into the rails 14.

The composite boards are made from recycled lumber. More specifically, the old lumber from redwood fences and decks that have been torn down is usually brought to a rubbish disposal area. Instead of burying the used lumber with the rest of the garbage for decomposition or grinding the board into fuel, the present invention recycles the used lumber and creates aesthetically pleasing, composite redwood boards that have enhanced rigidity and stability. In the preferred embodiment, 1"×8" panels are used because that is the most common size of board used for redwood fencing. The 1"×1" rails are cut from other sizes of used lumber, such as 4"×4" posts and 2"×4" beams. The boards are planed for smoothness and beauty prior to being lapped and assembled together After the rails are added and the composite board is complete, the board is cut to a predetermined length. Most composite boards are 5' in length as that is the standard height for fences. However, if desired the boards can be made into 4', 8' or any other length.

In addition to fencing, composite boards can be used for deck railing, patio enclosures, balconies or wherever an aesthetically pleasing screen is desired. Shorter pieces of composite board can be used to make flower beds and landscaping borders.

Although the present invention has been described above in terms of a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A composite board comprising:

at least two panels, each said panel being generally rectangular, having two opposing side edges and two opposing end edges;

each said panel having at least one end edge that is formed as a lap joint;

said panels being disposed adjacent one another, such that said lap joints abut one another in a mating fashion;

a pair of rails, one said rail being disposed proximate each said side edge of said panels; and fastening means engaged to said side rails and said side edges of each said panels, for attaching said rails to said panels.

2. A composite board in accordance with claim 1 wherein at least one of said rails includes a dado formed along the length of said rail, said side edges of said panels being engagably disposed within said dado.

3. A composite board in accordance with claim 1 wherein said fastening means are staples.

4. A composite board in accordance with claim 1 wherein said panels are made of recycled lumber.

5. A composite board in accordance with claim 1 wherein said rails are made of recycled lumber.

6. A fence comprising:

at least two post members;

at least two beam members including a header beam and a footer beam;

a plurality of composite board members, said board member being engagably disposed between said post members and said upper and lower beam members;

each said composite board member including:

at least two panels, each said panel being generally rectangular, having two opposing side edges and two opposing end edges;

each said panel having at least one end edge that is formed as a lap joint;

said panels being disposed adjacent one another, such that said lap joints abut one another in a mating fashion;

a pair of rails, one said rail being disposed proximate each said side edge of said panels; and fastening means engaged to said side rails and said side edges of each said panels, for attaching said rails to said panels.

* * * * *